US007493907B2

(12) United States Patent
Roh

(10) Patent No.: US 7,493,907 B2
(45) Date of Patent: Feb. 24, 2009

(54) NOZZLE ASSEMBLY OF DISHWASHER

(75) Inventor: Hee Seok Roh, Changwon-si (KR)

(73) Assignee: LG Electronics Inc., Seoul (KR)

( * ) Notice: Subject to any disclaimer, the term of this patent is extended or adjusted under 35 U.S.C. 154(b) by 456 days.

(21) Appl. No.: 10/721,737

(22) Filed: Nov. 26, 2003

(65) Prior Publication Data

US 2004/0163685 A1 Aug. 26, 2004

(30) Foreign Application Priority Data

Nov. 28, 2002 (KR) ..... 10-2002-0074991

(51) Int. Cl.
*B08B 3/00* (2006.01)

(52) U.S. Cl. ..... 134/58 D; 134/57 D; 134/115 R; 134/144; 134/169 R; 134/172; 134/175; 134/176; 134/177; 134/178; 134/179

(58) Field of Classification Search ..... 134/58 D, 134/166 R, 167 R, 169, 172, 173, 175–181, 134/57 D, 95.3, 104.1, 115 R, 144, 169 R; 131/167 R, 169, 172, 173, 175, 176, 177, 131/180, 181
See application file for complete search history.

(56) References Cited

U.S. PATENT DOCUMENTS 3,180,348 A * 4/1965 Clearman ..... 134/176
3,648,931 A * 3/1972 Jacobs ..... 239/248
4,094,702 A * 6/1978 Rabuffetti ..... 134/10
4,961,597 A * 10/1990 Bowen ..... 285/24
5,331,986 A * 7/1994 Lim et al. ..... 134/88
5,662,744 A * 9/1997 Tuller et al. ..... 134/25.2
5,725,002 A * 3/1998 Payzant ..... 134/95.3
5,899,433 A * 5/1999 Kim et al. ..... 251/30.01
6,357,460 B1 * 3/2002 Bertsch et al. ..... 134/174

FOREIGN PATENT DOCUMENTS

GB 2199734 A * 7/1988

* cited by examiner

*Primary Examiner*—Michael Barr
*Assistant Examiner*—Rita R Patel
(74) *Attorney, Agent, or Firm*—Ked & Associates LLP

(57) ABSTRACT

An improved nozzle assembly for a dishwasher is provided. The nozzle assembly includes first and second nozzles rotatably installed adjacent to corresponding first and second racks so as to selectively spray water in first and second directions. One of the nozzles includes a device for manually setting the spraying direction, including a fixed central piece and first and second nozzle sections. The fixed central piece is in communication with a water circulator, and supplies water to the first and second nozzle sections. An open end of each nozzle section is rotatably coupled to an open end of the fixed central piece, and the first and second nozzle sections may be rotated using a manual setting device so as to direct a spray of water in different directions.

25 Claims, 5 Drawing Sheets

NOZZLE ASSEMBLY OF DISHWASHER

This application claims the benefit of Korean Application No. 10-2002-0074991 filed on Nov. 28, 2002, which is hereby incorporated by reference.

BACKGROUND OF THE INVENTION

1. Field of the Invention

The present invention relates to a dishwasher, and more particularly, to a nozzle assembly of a dishwasher having top and bottom racks, employing a top nozzle having reversible nozzle pieces enabling the selective spraying of water toward the top or bottom rack according to a manual setting of the top nozzle by the user.

2. Discussion of the Related Art

Generally speaking, a dishwasher is provided with a water circulation means actuated by a wash pump installed in a bottom compartment of the dishwasher. Thus, the washing of a number of items, such as tableware and the like, is performed by spraying washing water onto the items, which are placed on one or more racks to be washed, and the spaying action is achieved by at least one nozzle rotating under the force of the wash pump. That is, a dishwasher for the efficient washing of a large number of items simultaneously is typically provided with top and bottom racks and a nozzle assembly comprising top and bottom nozzles respectively dedicated for spraying water toward the corresponding rack. Each nozzle communicates with the water circulating means via one of two injection passages for simultaneously transmitting the water from the wash pump to a plurality of injection holes formed in the nozzles. Such a dishwasher is shown in FIG. 1, with a top nozzle of the nozzle assembly detailed in FIG. 2.

Referring to FIGS. 1 and 2, a dishwasher having a nozzle assembly according to a related art is comprised of a washtub 4 installed in a body 2 to have upper and lower spaces for washing items; top and bottom racks 8 and 9, slidably installed in the upper and lower spaces of the washtub, for holding a number of items to be washed; a top nozzle 12, rotatably installed under the top rack, for spraying water upward onto the top rack through a plurality of injection holes 12*h* provided on an upper surface; and a bottom nozzle 14, rotatably installed under the bottom rack, for spraying water upward onto the bottom rack through a plurality of injection holes 14*h* provided on an upper surface. The top and bottom nozzles 12 and 14 each communicate separately with the water circulating means via top and bottom injection passages 26 and 28, respectively.

The above-described dishwasher having a nozzle assembly according to the related art may be operated at capacity by placing a large number of items to be washed in both racks, but when operating the dishwasher at less then maximum capacity, the items to be washed may only fill one rack, for example, the bottom rack. Therefore, in using such a dishwasher at some capacity less than maximum, where items are placed in the bottom rack only, the simultaneous operation of both nozzles wastes water and energy, since the injection holes of the top nozzle are fixed to face the top rack and thus spray water onto an empty top rack.

SUMMARY OF THE INVENTION

Accordingly, the present invention is directed to a nozzle assembly of a dishwasher that substantially obviates one or more of the problems due to limitations and disadvantages of the related art.

An object of the present invention, which has been devised to solve the foregoing problem, lies in providing a nozzle assembly of a dishwasher, which enables injection holes of a top nozzle to face a top or bottom rack selectively, to spray water toward either rack.

It is another object of the present invention to provide a nozzle assembly of a dishwasher having top and bottom racks, which enables an enhanced washing performance for reduced-capacity loads.

It is another object of the present invention to provide a nozzle assembly of a dishwasher having top and bottom racks, which enables a shorter washing time for reduced-capacity loads.

Additional features and advantages of the invention will be set forth in the description which follows, and in part will be apparent to those having ordinary skill in the art upon examination of the following or may be learned from a practice of the invention. The objectives and other advantages of the invention will be realized and attained by the subject matter particularly pointed out in the specification and claims hereof as well as in the appended drawings.

To achieve these objects and other advantages in accordance with the present invention, as embodied and broadly described herein, there is provided a nozzle assembly of a dishwasher having first and second racks for holding items to be washed, the nozzle assembly including a first nozzle, rotatably installed adjacent the first rack, for selectively spraying water in first and second directions. The first nozzle comprises means for manually setting the spraying direction of the first nozzle.

It is to be understood that both the foregoing explanation and the following detailed description of the present invention are exemplary and illustrative and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT

Reference will now be made in detail to the preferred embodiment of the present invention, examples of which are illustrated in the accompanying drawings. Throughout the drawings, like elements are indicated using the same or similar reference designations where possible.

Figure 1:
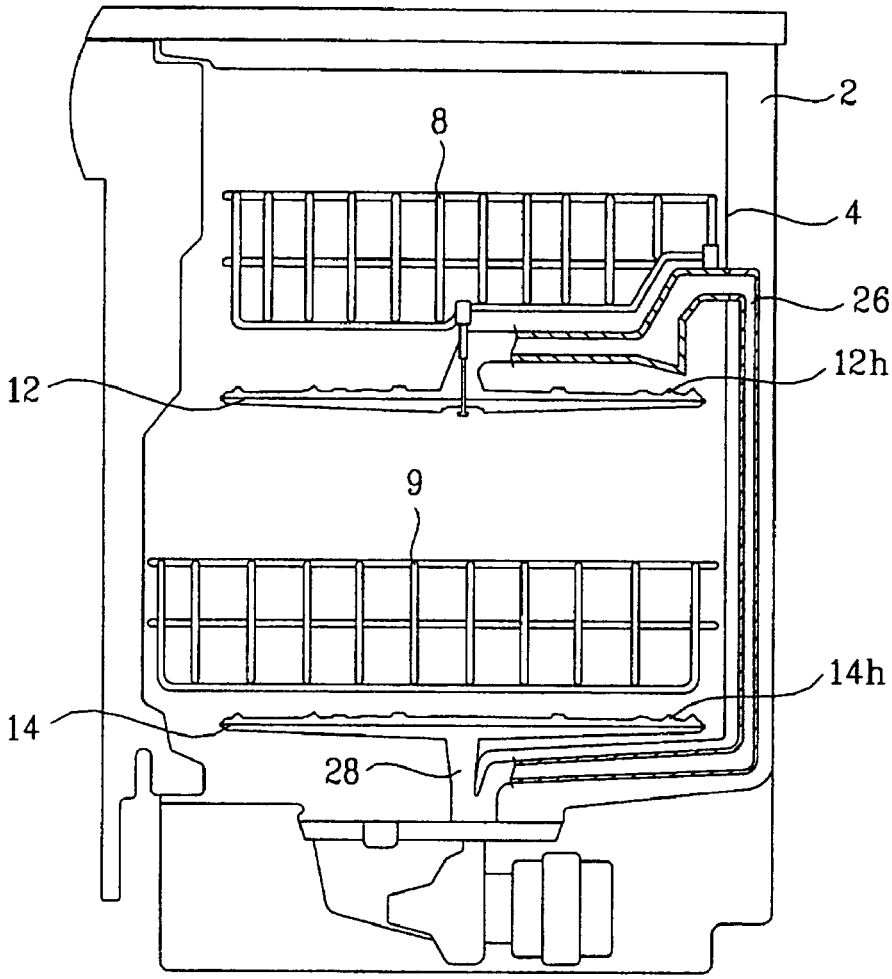
FIG. 1 Related Art
FIG. 1 is a cross-sectional view of a dishwasher having a nozzle assembly according to a related art.
Figure 2:
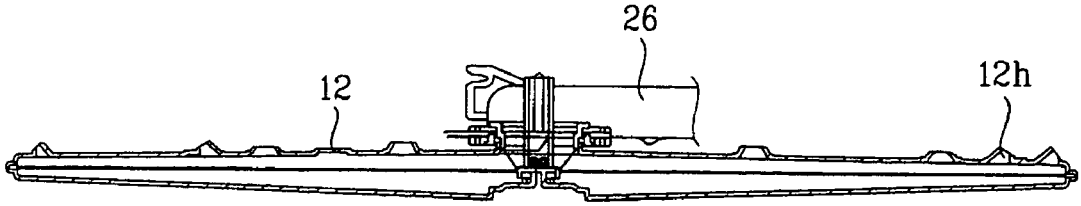
FIG. 2 Related Art
FIG. 2 is a cross-sectional view of the top nozzle of the dishwasher of FIG. 1.
Figure 3:
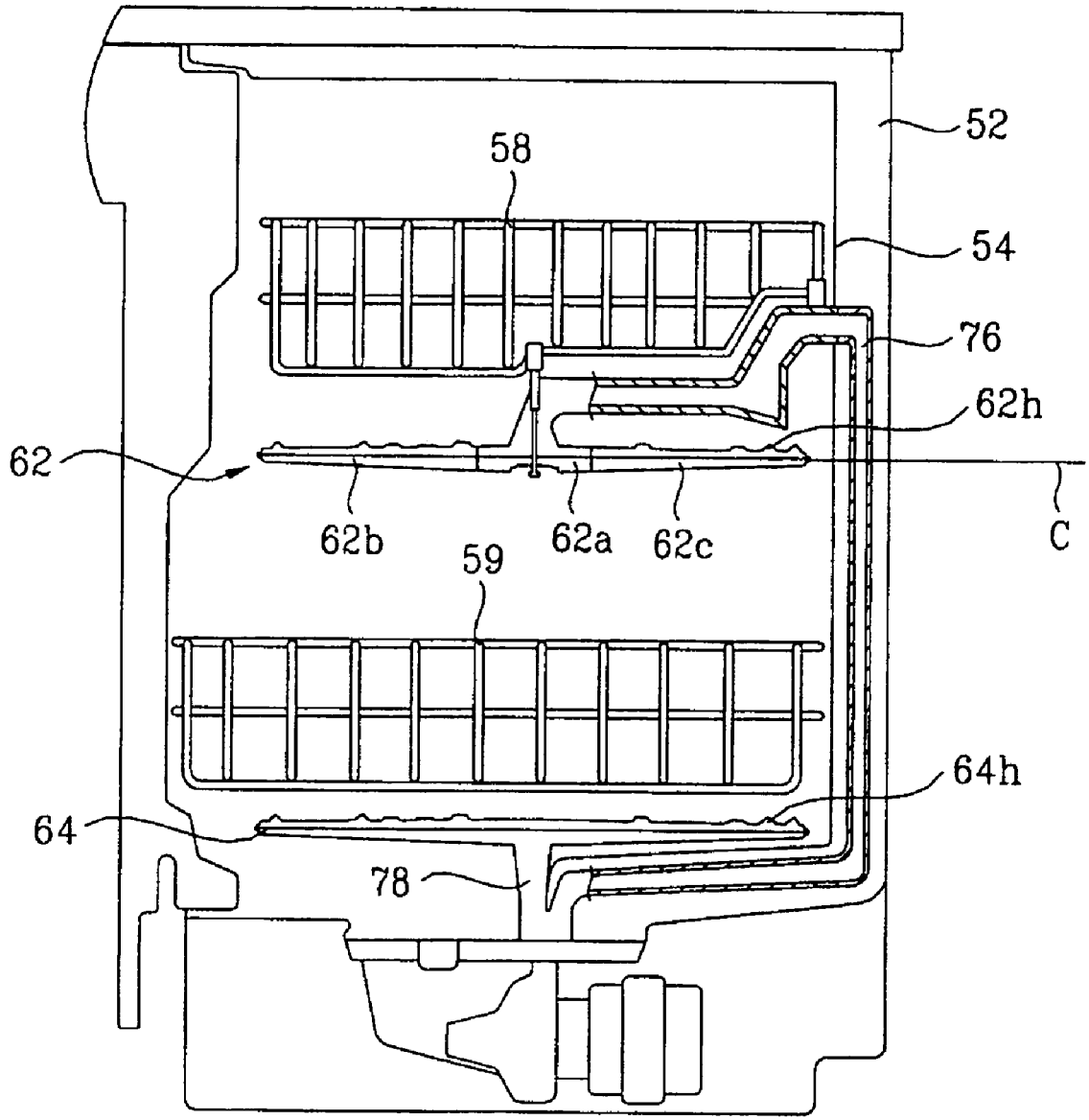
FIG. 3 is a cross-sectional view of a dishwasher having a nozzle assembly according to the present invention.
Figure 4:
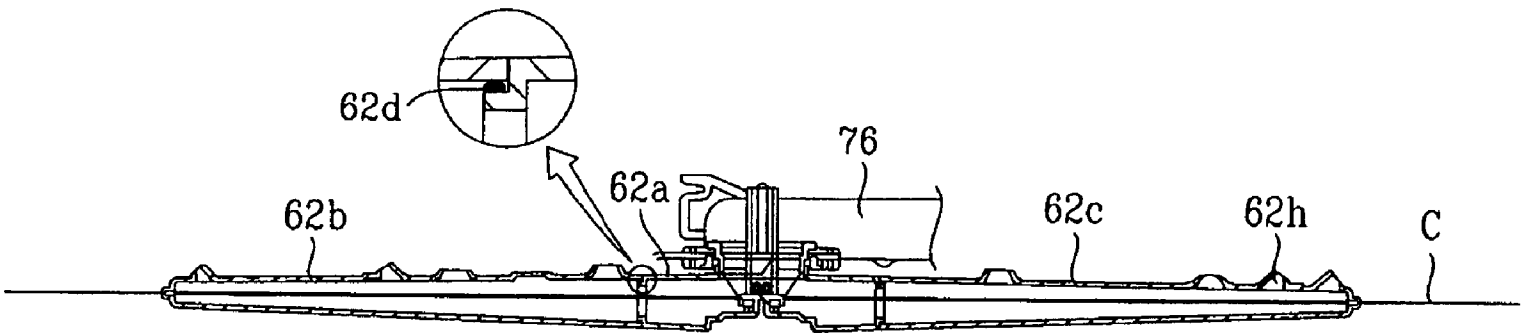
FIG. 4 is a cross-sectional view of the top nozzle of the dishwasher of FIG. 3.
Figure 5:
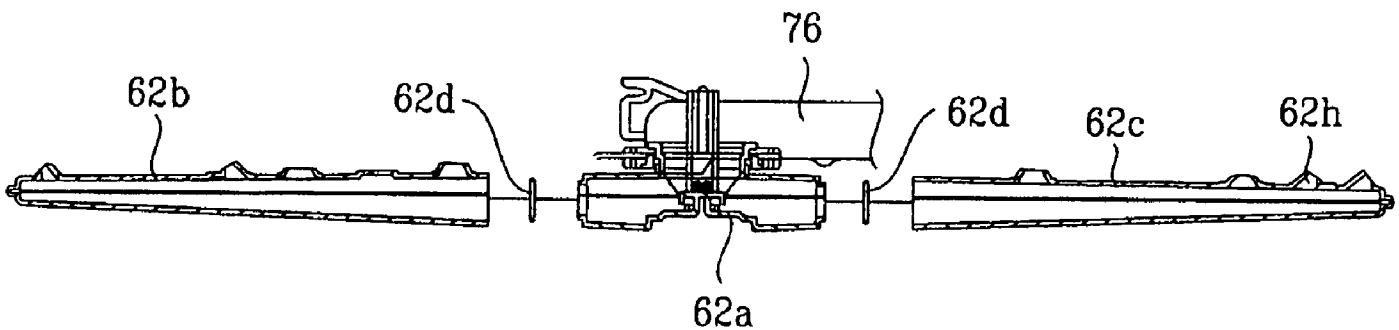
FIG. 5 is a breakaway view of the top nozzle as shown in FIG. 4.

Referring to FIGS. 3-5, a dishwasher having a nozzle assembly according to the present invention is comprised of a washtub 54 installed in a body 52 to have upper and lower spaces for washing items; top and bottom racks 58 and 59, slidably installed in the upper and lower spaces of the washtub, for holding a number of items to be washed; a top nozzle 62, rotatably installed under the top rack, for spraying water toward the items to be washed through a plurality of injection holes 62*h* provided on a side surface; and a bottom nozzle 64, rotatably installed under the bottom rack, for spraying water upward onto the bottom rack through a plurality of injection holes 64*h* provided on an upper surface. The top and bottom nozzles 62 and 64 each communicate separately with the water circulating means via top and bottom injection passages 76 and 78, respectively.

According to the present invention, the top nozzle 62 is provided with a means for manually setting a spraying direction, toward items placed in the top rack 58 or the bottom rack 59, by selecting one of two configurations of the top nozzle. To accomplish this, the top nozzle 62 comprises a fixed central piece 62*a* communicating with the top injection passage 76 and having open ends and first and second nozzle sections 62*b* and 62*c* each having an open end which is rotatably coupled to each end of the fixed central piece. The open ends of the first and second nozzle sections 62*b* and 62*c* are respectively fitted into the corresponding end of the fixed central piece 62*a*, allowing a 180° rotation about an axis C of the top nozzle. Thus, the first and second nozzle sections 62*b* and 62*c* communicate with the top injection passage 76 via the fixed central piece 62*a*, and the plurality of injection holes 62*h* provided on the side surface of the top nozzle 62 are equally distributed on the rotatable first and second nozzle sections, so that water may be selectively directed toward the top or bottom rack 58 or 59 by manually rotating the first and second nozzle sections.

The above selective rotation of the first and second nozzle sections 62*b* and 62*c* is enabled by a symmetrical formation, about a horizontal plane passing through the axis C, of the connecting surfaces between the fixed central piece 62*a* and the first and second nozzle sections 62*b* and 62*c*. The open ends of the central part 62*a* are each stepped, and the inner diameter dimension of the first and second nozzle sections 62*b* and 62*c* is greater than an outer diameter of the stepped surface of the open ends of the fixed central piece 62*a*. Meanwhile, the top nozzle 62 further comprises a pair of rubber based O-rings 62*d* installed at the connecting surfaces between the fixed central piece 62*a* and the first and second nozzle sections 62*b* and 62*c*, to secure their setting while preventing water leakage during operation. In fitting the O-rings 62*d* to the top nozzle 62, one O-ring is forcibly fitted over each stepped end of the fixed central piece 62*a*.

Figure 6:
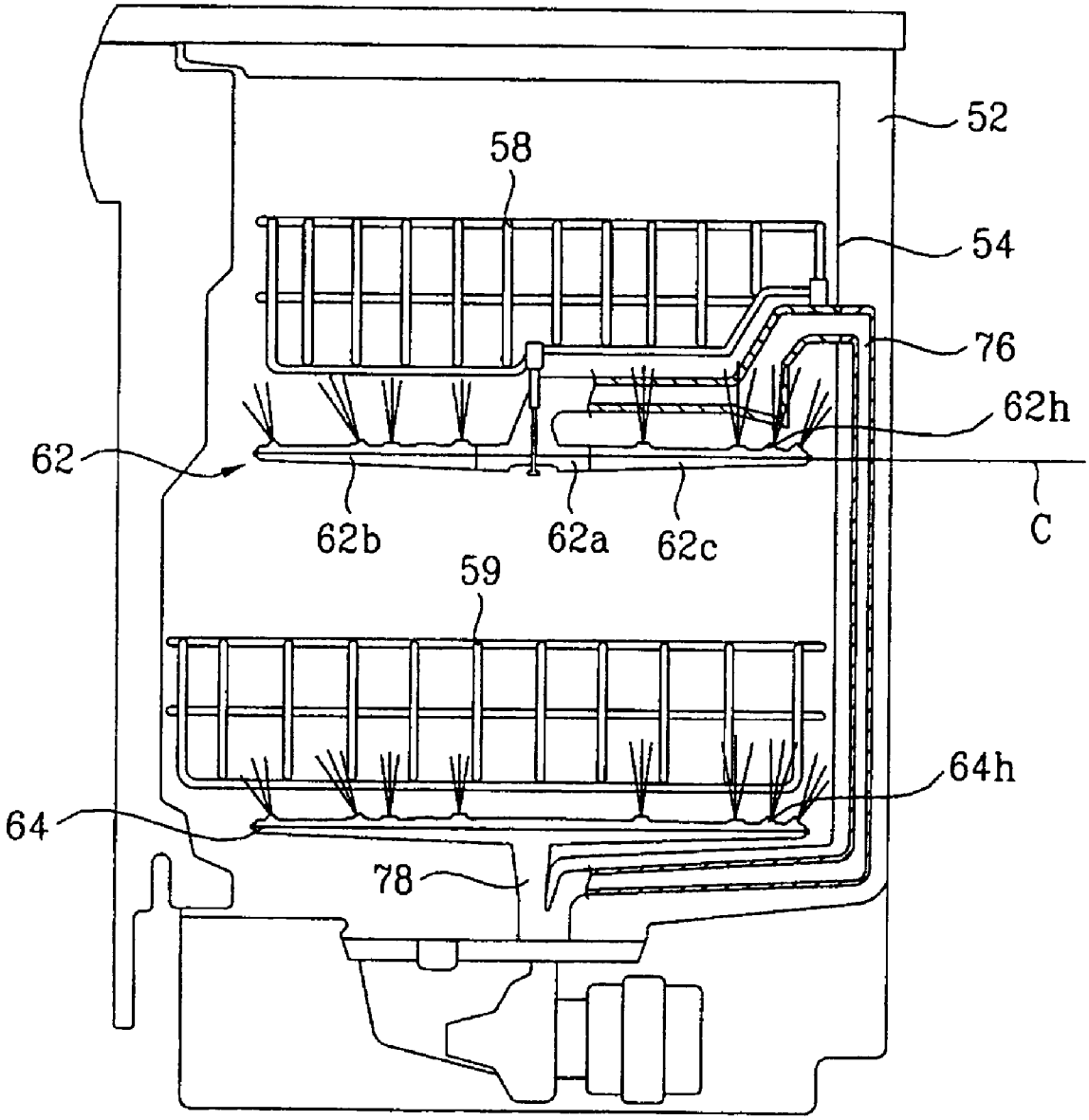
FIGS. 6 and 7 are cross-sectional views of a dishwasher having a nozzle assembly according to the present invention, illustrating user-selected operational states of the dishwasher.

FIG. 6 illustrates an operational state of a dishwasher having the above nozzle assembly according to the present invention, in which the dishwasher is operated at capacity; that is, items to be washed are loaded on both racks. In this case, the user selects a first configuration by rotating the first and second nozzle sections 62*b* and 62*c* of the top nozzle 62 with respect to the fixed central piece 62*a*, to direct the spraying water toward the top rack 58.

Figure 7:
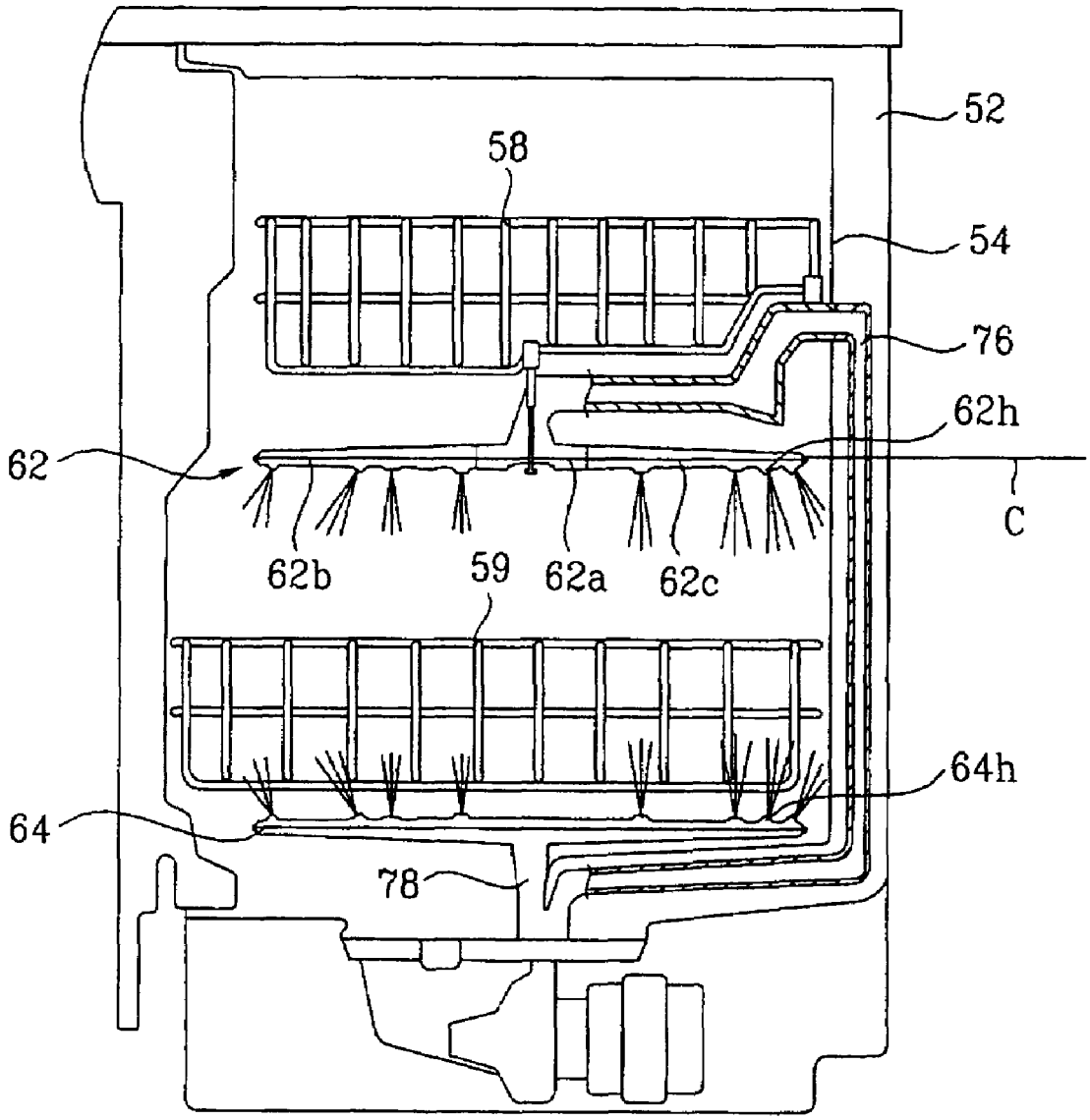

FIG. 7 illustrates an operational state of a dishwasher having the above nozzle assembly according to the present invention, in which the dishwasher is operated at a reduced capacity. In this case, the items to be washed are loaded on the bottom rack only. Therefore, the user selects a second configuration by rotating the first and second nozzle sections 62*b* and 62*c* of the top nozzle 62 with respect to the fixed central piece 62*a*, to direct the spraying water downward to the bottom rack 59. In doing so, the washing time of the reduced-capacity load is shortened while providing enhanced washing performance.

The first and second nozzle sections 62*b* and 62*c* are preferably ganged together, such that a twisting action applied to one nozzle will rotate both, in unison, with respect to the fixed central piece 62*a*.

Accordingly, in a dishwasher adopting the nozzle assembly according to the present invention, the first and second nozzle sections having injection holes formed in one side of each section are rotatably installed on the ends of the fixed central piece, enabling the selective directional positioning of the nozzle assembly's top nozzle to accommodate large- and small-capacity loads as necessary, thereby shortening a washing time, improving a washing performance, and saving water and energy.

It will be apparent to those skilled in the art that various modifications and variations can be made in the present invention without departing from the spirit or scope of the invention. Thus, it is intended that the present invention cover such modifications and variations, provided they come within the scope of the appended claims and their equivalents.

What is claimed is:

1. A nozzle assembly for a dishwasher having first and second racks for holding items to be washed, the nozzle assembly including:

a fixed central piece; and a first nozzle rotatably provided proximate to the first rack and undetachably and rotatably coupled to the fixed central piece, wherein the first nozzle comprises first and second nozzle sections each of which is independently coupled to the fixed central piece so as to be rotatable about a horizontal axis with respect to the fixed central piece and sprays a washing fluid toward a first rack direction or toward a second rack direction.

2. The nozzle assembly as claimed in claim 1, further comprising a fluid circulating device in communication with the first nozzle, wherein the fluid circulating device supplies washing fluid under pressure to the first nozzle for spraying therethrough, and wherein the fluid under pressure rotates the first nozzle about a vertical axis of rotation.

3. The nozzle assembly as claimed in claim 2, wherein the fixed central piece has two open ends, wherein the first and second nozzle sections each have a closed end and an open end, and wherein the open end of each nozzle section is rotatably coupled to one of the two open ends of the fixed central piece.

4. The nozzle assembly as claimed in claim 3, wherein the first nozzle is configured to selectively spray washing fluid toward the first rack direction in a first mode or toward the second rack direction in a second mode, and wherein changing from the first mode to the second mode is done by rotating the first and second nozzle sections about their respective horizontal axis.

5. The nozzle assembly as claimed in claim 3, wherein the fixed central piece and the first and second nozzle sections are symmetrical about a vertical plane passing through a central axis of the fixed central piece.

6. The nozzle assembly as claimed in claim 3, wherein a manual rotation of one of the first and second nozzle sections about its respective horizontal axis causes a corresponding rotation of the other of the first and second nozzle sections.

7. The nozzle assembly as claimed in claim 3, wherein the first nozzle further comprises a pair of O-rings respectively installed at connecting surfaces between the fixed central piece and the first and second nozzle sections.

8. The nozzle assembly as claimed in claim 7, wherein the open ends of the fixed central piece each have a stepped surface configured to receive one of the pair of O-rings.

9. The nozzle assembly as claimed in claim 7, wherein the pair of O-rings are made of a rubber based material so as to prevent leakage at the connecting surfaces and to resist rotation during operation of the nozzle assembly.

10. The nozzle assembly as claimed in claim 3, wherein each of the first and second nozzle sections has first and second surfaces extending between their respective open and closed ends, and wherein the first surface of each of the first and second nozzle sections each include a plurality of holes in fluid communication with the fixed central piece via the open ends of the first and second nozzle sections and the fixed central piece.

11. The nozzle assembly as claimed in claim 1, further comprising a second nozzle rotatably provided proximate to the second rack, wherein the second nozzle is configured to direct washing fluid toward the second rack.

12. The nozzle assembly as claimed in claim 11, further comprising a fluid circulating device in communication with the second nozzle, wherein the fluid circulating device is configured to supply washing fluid under pressure to the second nozzle for spraying therethrough, and to rotate the second nozzle by the pressure of the supplied washing fluid.

13. The nozzle assembly as claimed in claim 11, wherein the first and second racks are top and bottom racks, respectively, and the first and second nozzles are top and bottom nozzles, respectively.

14. The nozzle assembly as claimed in claim 11, wherein the first and second nozzles are disposed substantially parallel to the first and second racks, respectively.

15. The nozzle assembly as claimed in claim 1, wherein each of the first and second nozzle sections includes a first side surface and a second side surface, and wherein a plurality of injection holes are formed on the first side surface so as to spray washing fluid upward toward the first rack direction, and to spray washing fluid downward toward the second rack direction when the respective nozzle section is rotated about its respective horizontal axis so as to change an orientation of the holes.

16. The nozzle assembly as claimed in claim 1, wherein each of the first and second nozzle sections is configured to rotate 180 degrees about its respective horizontal axis of rotation.

17. The nozzle assembly as claimed in claim 1, wherein the washing fluid is water, detergents, soil particles, or any combination thereof.

18. A dishwasher comprising the nozzle assembly of claim 1.

19. The nozzle assembly of claim 1, wherein the first and second nozzle sections spray washing fluid only toward the first rack direction in a first mode, and only toward the second rack direction in a second mode.

20. A nozzle assembly for a home appliance, the nozzle assembly comprising:

a nozzle that sprays washing fluid in first and second directions simultaneously or selectively, wherein the nozzle comprises:

a fixed central piece with one end in fluid communication with a fluid circulating device, and another end having first and second openings; and first and second nozzle sections, each comprising:

a closed end and an open end, wherein the open end of the first and second nozzle sections is undetachably and independently coupled to the first and second openings of the fixed central piece so as to be rotatable with respect thereto;

first and second surfaces extending between the open and closed ends of each of the first and second nozzle sections; and a plurality of holes formed along one of the first surfaces and the second surfaces of the first and second nozzle sections, wherein the plurality of holes are in fluid communication with the fixed central piece through the respective open ends so as to allow washing fluid to be sprayed therethrough, and wherein, while coupled to the fixed central piece, the first and second nozzle sections are rotatable about a horizontal axis thereof while the fixed central piece remains stationary so as to adjust a position of the first surfaces of the first and second nozzle sections and the plurality of holes therein.

21. The nozzle assembly of claim 20, wherein a manual rotation of one of the first or second nozzle sections about the horizontal axis causes a corresponding rotation of the other of the first or second nozzle sections such that the plurality of holes formed in the first and second nozzle sections are configured to all spray washing fluid in the same direction based on a rotational position of the first and second nozzle sections relative to the fixed central piece.

22. The nozzle assembly of claim 20, wherein the first nozzle is configured to selectively spray washing fluid toward the first rack direction in a first mode or toward the second rack direction in a second mode, and wherein changing from the first mode to the second mode is done by detaching the first and second nozzle sections from the fixed central piece, and re-attaching the fast and second nozzle sections to the fixed central piece such that an orientation of the first and second nozzle sections is rotated 180° about their respective horizontal axis.

23. The nozzle assembly of claim 20, wherein the plurality of injection holes are formed only in the first side surface such that washing fluid is sprayed only toward a first rack direction or only toward a second rack direction based on the orientation of the holes.

24. The nozzle assembly of claim 20, wherein the second surfaces of the first and second nozzle sections are continuous such that washing fluid cannot pass therethrough.

25. A home appliance comprising the nozzle assembly of claim 20.

* * * * *